US011809103B2

(12) United States Patent
Ishikura

(10) Patent No.: US 11,809,103 B2
(45) Date of Patent: Nov. 7, 2023

(54) IMAGE FORMATION APPARATUS

(71) Applicant: Oki Electric Industry Co., Ltd., Tokyo (JP)

(72) Inventor: Hiroki Ishikura, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/546,634

(22) Filed: Dec. 9, 2021

(65) Prior Publication Data

US 2022/0299913 A1 Sep. 22, 2022

(30) Foreign Application Priority Data

Mar. 22, 2021 (JP) ..... 2021-046800

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

2004/0057493 A1* 3/2004 Ishikawa ..... G01J 5/051 374/E13.003
2007/0177895 A1* 8/2007 Yano ..... G03G 21/20 399/122

FOREIGN PATENT DOCUMENTS

JP 2008-225471 A 9/2008

* cited by examiner

*Primary Examiner* — Stephanie E Bloss
*Assistant Examiner* — Michael A Harrison
(74) *Attorney, Agent, or Firm* — METROLEX IP LAW GROUP, PLLC

(57) ABSTRACT

An image formation apparatus according to one or more embodiments may include: an apparatus main body that includes an image formation section configured to form an image on a medium; a fixation device that includes a fixation member configured to heat the medium and is attachable to the apparatus main body in a first direction; and a temperature detector including a lens, provided in the apparatus main body, and configured to detect a temperature of the fixation member through the lens. An optical axis of the lens is inclined with respect to the first direction.

11 Claims, 14 Drawing Sheets

IMAGE FORMATION APPARATUS

CROSS REFERENCE TO RELATED APPLICATIONS

This application claims priority based on 35 USC 119 from prior Japanese Patent Application No. 2021-46800 filed on Mar. 22, 2021, entitled "IMAGE FORMATION APPARATUS", the entire contents of which are incorporated herein by reference.

BACKGROUND

The disclosure may relate to an image formation apparatus.

An image formation apparatus has been proposed in which an infrared temperature sensor, which is a temperature detector that detects a temperature of a fixation member (e.g., a heating roller) of a fixation device that fixes a toner image on a medium, is provided outside the fixation device. See Patent Document 1: Japanese Patent Application Publication No. 2008-225471

SUMMARY

In such an image formation apparatus, it may be preferable that the temperature detector is not easily soiled.

An object of an embodiment of the disclosure may be to provide an image formation apparatus capable of preventing a temperature detector, which is provided in a main body of the image formation apparatus and configured to detect a temperature of a fixation member of a fixation device, from being easily soiled.

An aspect of the disclosure may be an image formation apparatus that may include: an apparatus main body that includes an image formation section configured to form an image on a medium; a fixation device that includes a fixation member configured to heat the medium and is attachable to the apparatus main body in a first direction; and a temperature detector including a lens, provided in the apparatus main body, and configured to detect a temperature of the fixation member through the lens. An optical axis of the lens is inclined with respect to the first direction.

According to the aspect described above, the image formation apparatus can prevent the lens of the temperature detector from being easily soiled.

DETAILED DESCRIPTION

Figure 1:
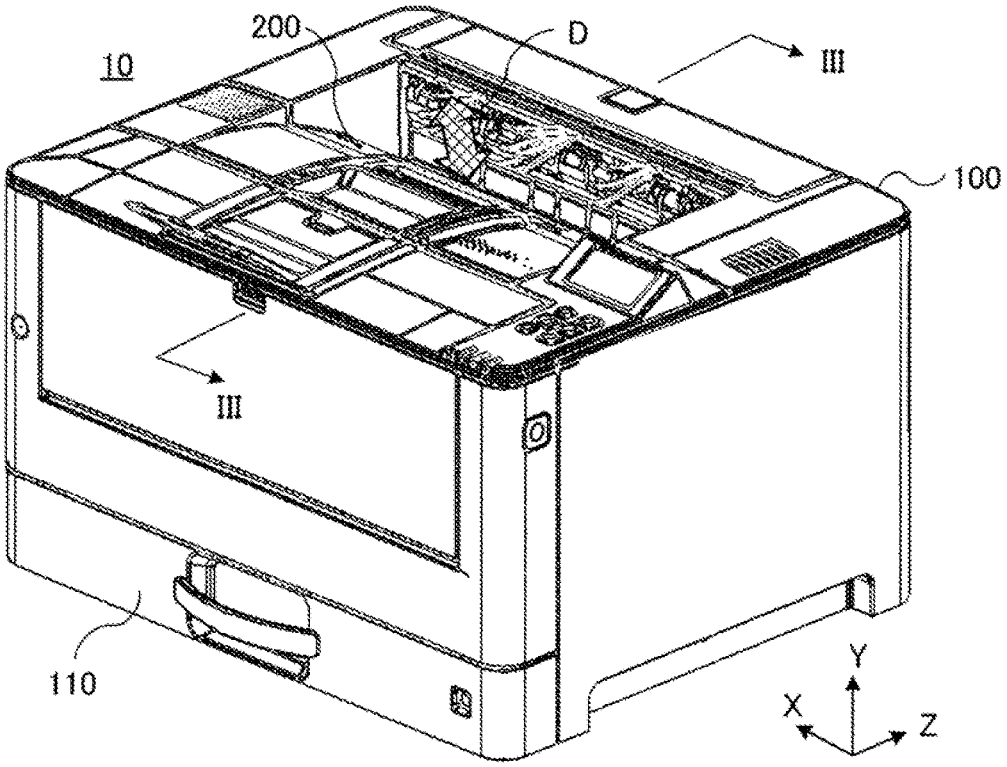
FIG. 1 is a diagram illustrating an external perspective view of an image formation apparatus according to a first embodiment.

Descriptions are provided hereinbelow for one or more embodiments based on the drawings. In the respective drawings referenced herein, the same constituents are designated by the same reference numerals and duplicate explanation concerning the same constituents is omitted. All of the drawings are provided to illustrate the respective examples only.

An image formation apparatus according to one or more embodiments is described below with reference to the drawings.

The coordinate axes of the XYZ Cartesian coordinate system are illustrated in the figures to make it easier to understand the relationship between the figures. The X axis is a coordinate axis extending in a width direction of the image formation apparatus (i.e., the width direction of the fixation device). The Y-axis is a coordinate axis extending in a height direction of the image formation apparatus orthogonal to the X-axis. The Z-axis is a horizontal coordinate axis orthogonal to both the X-axis and the Y-axis. In the figures, the same or similar configurations are designated by the same reference characters.

(1) First Embodiment (1-1) Image Formation Apparatus

Figure 2:
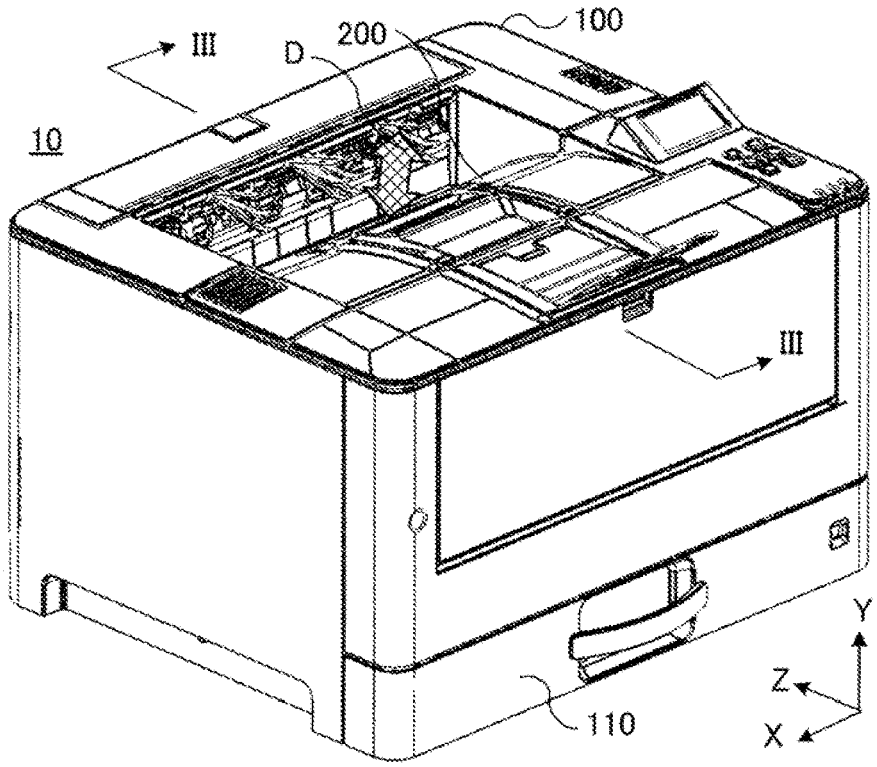
FIG. 2 is a diagram illustrating another external perspective view of the image formation apparatus illustrated in FIG. 1.
Figure 3:
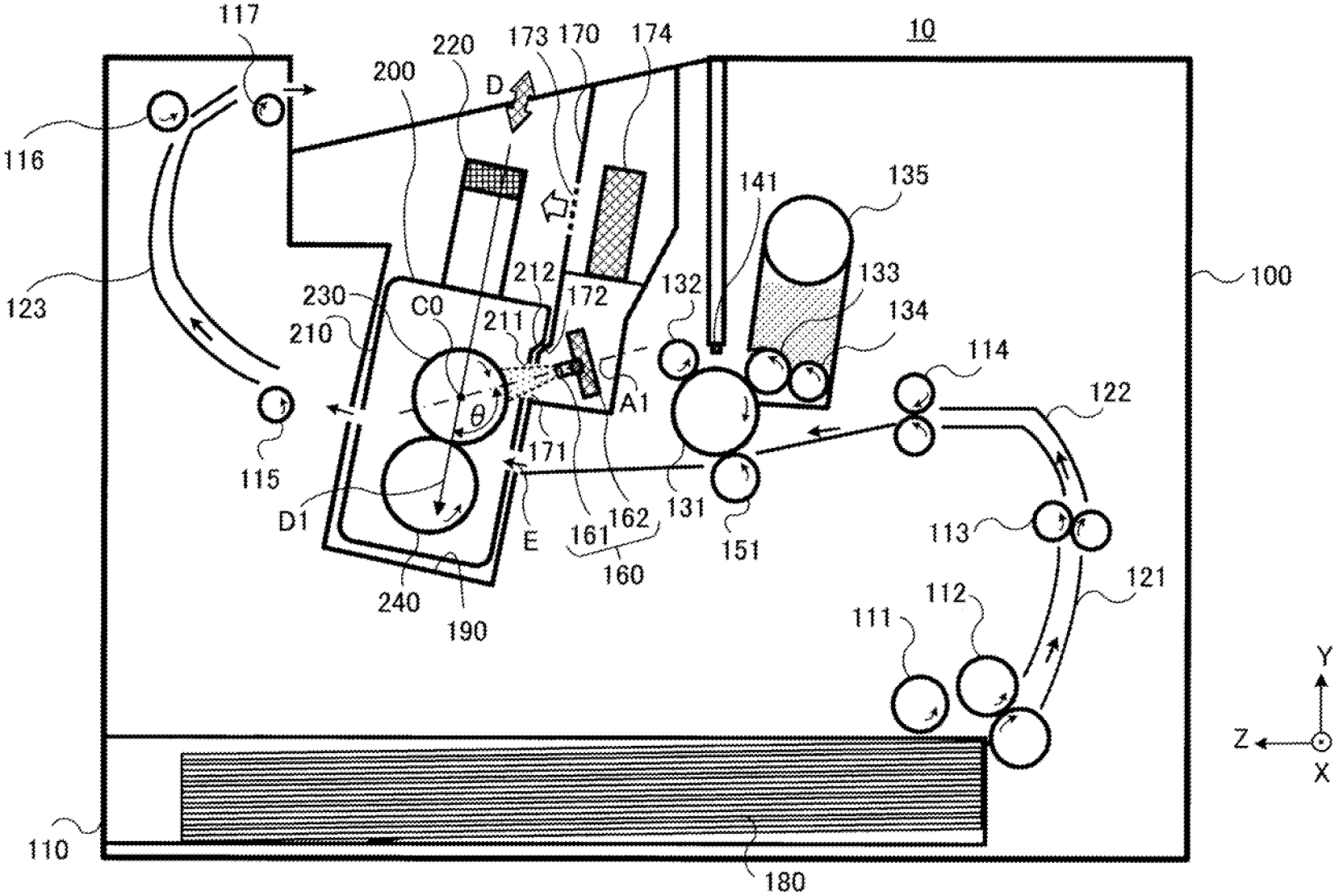
FIG. 3 is a diagram illustrating a schematic cross-sectional view of the image formation apparatus of FIG. 1 or FIG. 2 taken along the line III-III.

FIG. 1 is a diagram illustrating an external perspective view of an image formation apparatus 10 according to a first embodiment. FIG. 2 is a diagram illustrating another external perspective view of the image formation apparatus 10. FIG. 3 is a diagram illustrating a schematic cross-sectional view of the image formation apparatus 10 of FIG. 1 or FIG. 2 taken along the line III-III.

The image formation apparatus 10 is, for example, an electrophotographic printer. The image formation apparatus 10 is a monochrome printer. The image formation apparatus 10 may be a color printer. The image formation apparatus 10 includes an apparatus main body 100 including a housing of the image formation apparatus and a fixation device 200 (or a fixation unit) attachable and detachable to and from the apparatus main body 100. The apparatus main body 100 is provided with a media conveyance section that conveys a medium 180 and an image formation section that forms an image on the medium 180. The image formation apparatus may be provided with a reversing path (not illustrated) that reverses the front and back of the medium 180. The medium 180 is, for example, paper for printing. The medium 180 may be a printing medium such as an OHP sheet (overhead projector sheet), an envelope, or the like.

The image formation section includes: a photosensitive drum 131 as an image carrier; a charging roller 132 as a charging device or a charging member configured to uniformly charge a surface of the photosensitive drum 131; a development roller 133 as a developer carrier configured to attach a developer (toner) to an electrostatic latent image formed on the surface of the photosensitive drum 131 so as to form a developer image (toner image) on the surface of the photosensitive drum 31; and a toner supply roller 134 as a developer supply member disposed in pressure contact with the development roller 133. The toner supply roller 134 supplies the toner supplied from a toner cartridge 135 to the development roller 133. A development blade is pressed against the development roller 133. The development blade makes a thin layer of the toner supplied from the toner supply roller 134 on the development roller 133.

Above the photosensitive drum 131 (in the +Y direction), a print head 141, serving as an exposure device, that includes a plurality of semiconductor light emitting elements arranged in a line(s) in the X direction and is arranged so as to be opposed to the photosensitive drum 131. The print head is also referred to as a light emitting element (LED) head or a light emitting element (LED) array head. The print head 141 exposes the uniformly charged photosensitive drum 131 with light according to image data so as to form an electrostatic latent image based on the image data on the surface of the photosensitive drum 131. The semiconductor light emitting elements in the print head 141 are, for example, light emitting diodes (LED) or light emitting thyristors.

A transfer unit is provided below the photosensitive drum 131 (in the −Y direction). The transfer unit is provided with a transfer roller 151 as a transfer member. The transfer roller 151 is disposed so as to be opposed to the photosensitive drum 131. The transfer roller 151 charges the medium 180 passing through a transfer position with a polarity opposite to that of the toner, and thus transfers the toner image from the photosensitive drum 131 to the medium 180.

A paper feed mechanism configured to supply the medium 180 is provided in a lower part of the apparatus main body 100. The paper feed mechanism includes a media storage cassette 110, a hopping roller 111, a resist roller 112, and a roller pair 113 and a roller pair 114 configured to convey the medium 180 along guides 121 and 122.

A fixation device 200 is mounted (attached) in an accommodation section 190 (an accommodation recess) for accommodating therein the fixation device 200 in the apparatus main body 100. The fixation device 200 includes a fixation roller (i.e., a heating roller) serving as a fixation member and a backup roller (i.e., a pressure roller) serving as a pressure member. The fixation device 200 pressurizes and heats the toner image transferred on the medium 180 so as to fix the toner image to the medium 180. On a media discharge side of the fixation device 200, a roller 115, a guide 123, a roller 116, a roller 117, and a media stacker (media loading section) are provided.

Next, an operation of the image formation apparatus 1 is described. First, the media 180 loaded in the media storage cassette 110 are taken out one by one by the hopping roller 111 and sent to the resist roller 112. The medium 180 that is taken out is fed along the guides 121 and 122 from the resist roller 112 and is conveyed to the image formation section. In the image formation section, the surface of the photosensitive drum 131 is uniformly charged by the charging roller 132 and exposed by the print head 141, so that the electrostatic latent image is formed on the surface of the photosensitive drum 131. The thin-layered toner on the development roller 133 is electrostatically adhered to the electrostatic latent image, so as to form a toner image on the surface of the photosensitive drum 131. The toner image on the photosensitive drum 131 is transferred to the medium 180 by the transfer roller 151, so as to form a toner image on the medium 180. After transferring of the toner image to the medium 180, the toner remaining on the photosensitive drum 131 is removed by a cleaning device (not illustrated). The medium 180 on which the toner image has been formed is conveyed to the fixation device 200. In the fixation device 200, the toner image on the medium 180 is fixed to the medium 180, so that an image corresponding to the toner image is formed (printed) on the medium 180. The medium 180 on which the image has been formed (printed) is discharged to the media stacker, by the rollers 115, 116, and 117. Through this process, the image is formed (printed) on the medium 180.

(1-2) Fixation Device and Temperature Detector

Figure 4:
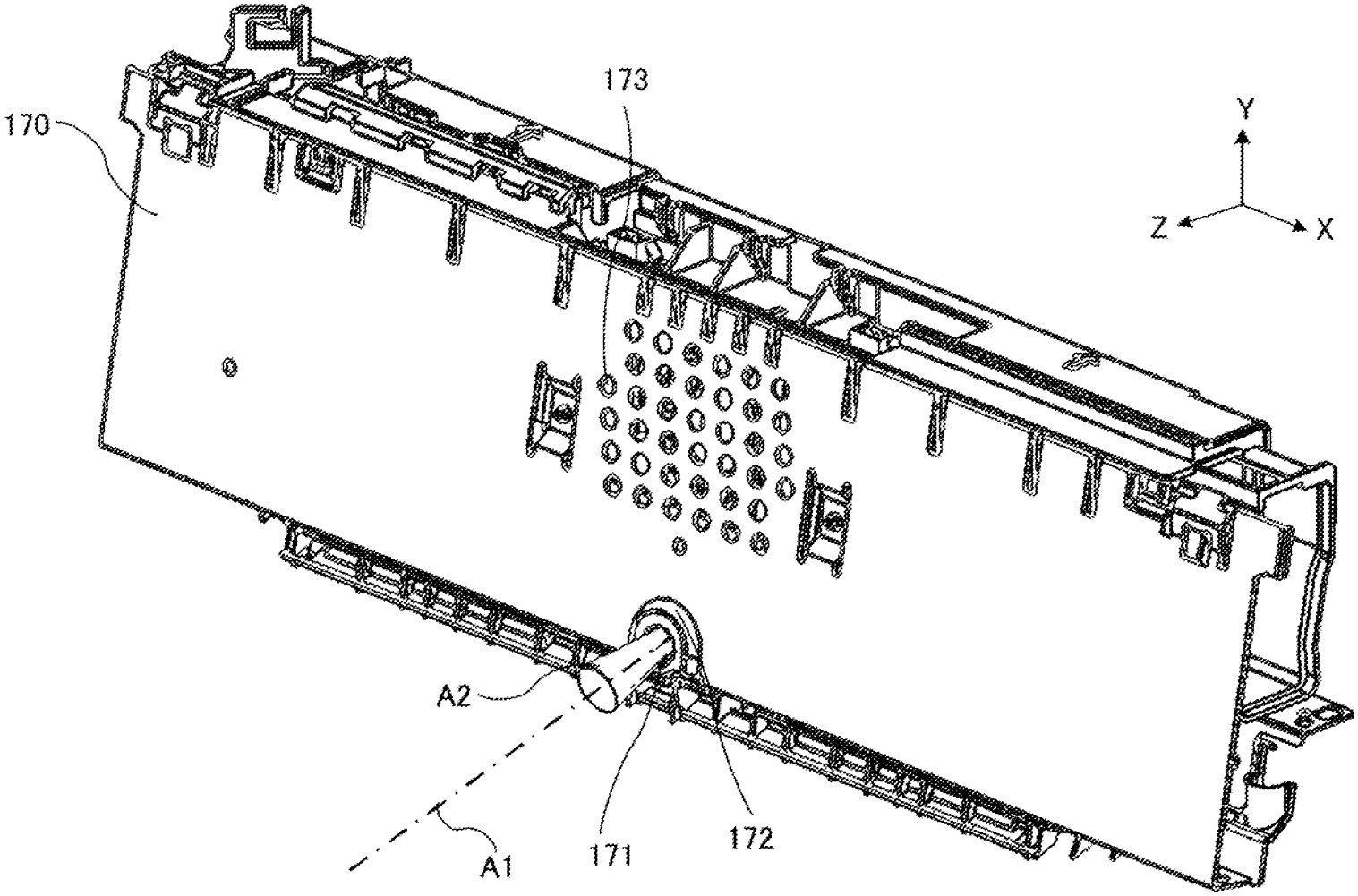
FIG. 4 is a diagram illustrating a perspective view of a structure including a temperature detector and a partition member in the image formation apparatus according to a first embodiment.
Figure 5:
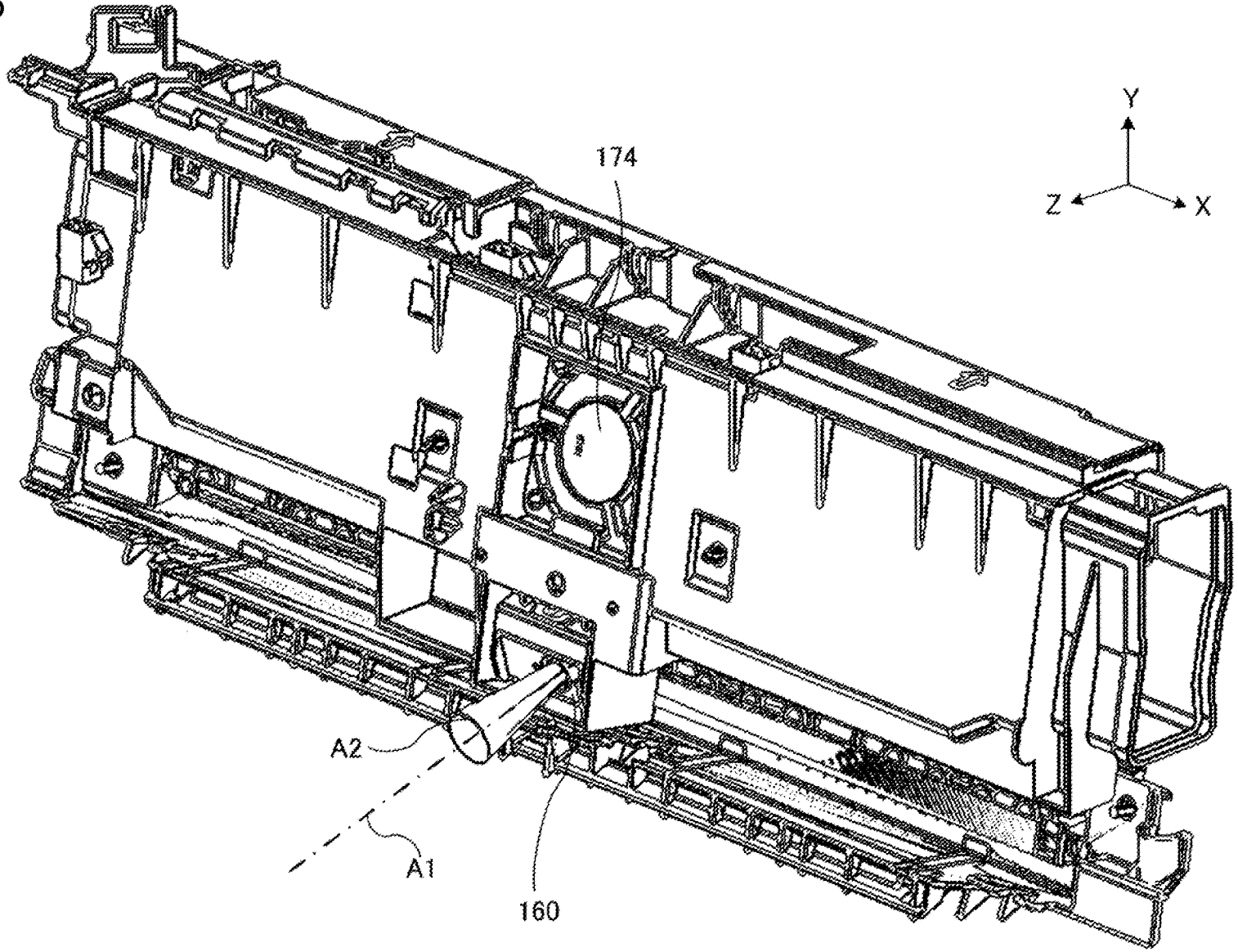
FIG. 5 is a diagram illustrating a perspective view of the structure illustrated in FIG. 4 with the partition member being omitted.
Figure 6:
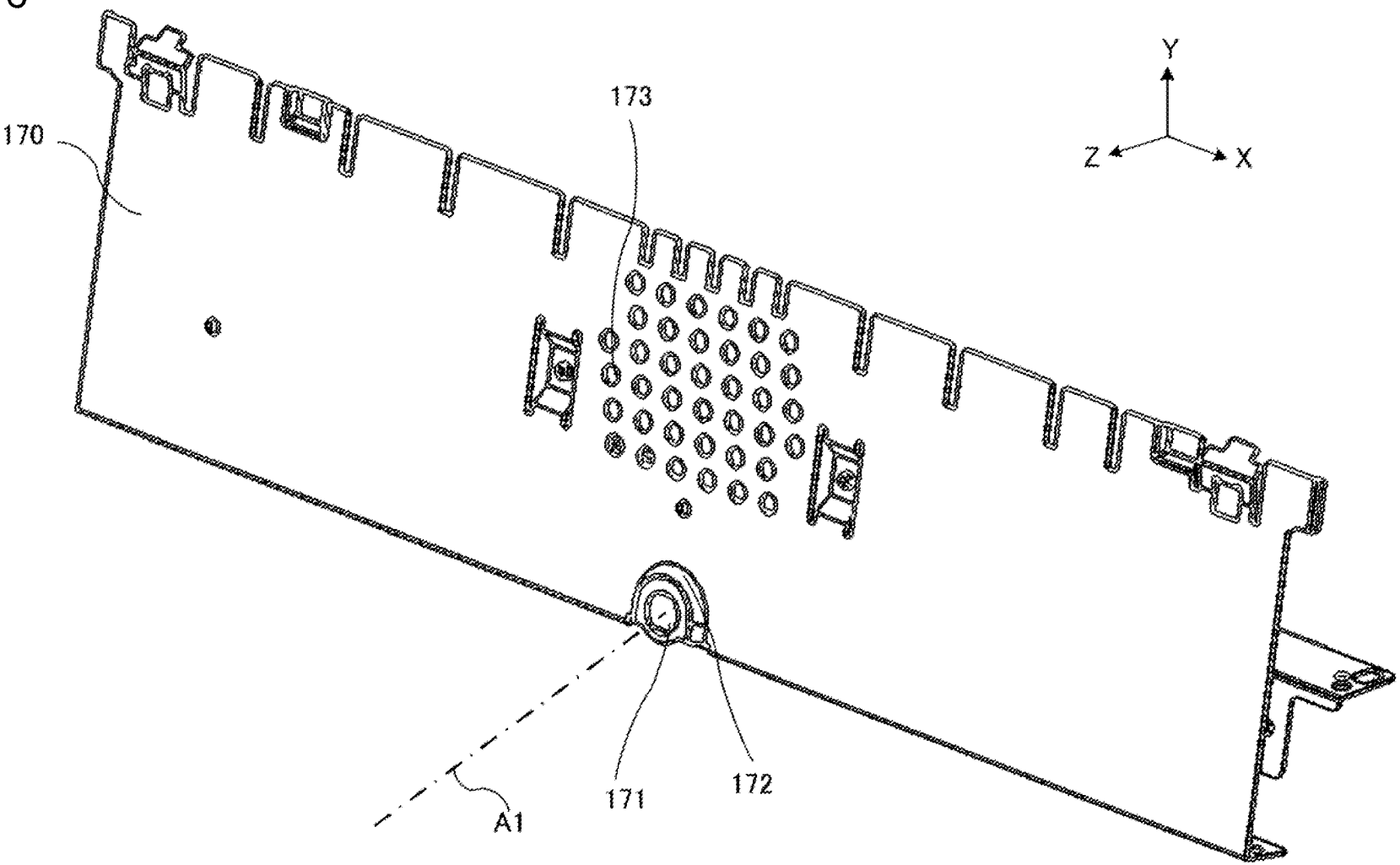
FIG. 6 is a diagram illustrating a perspective view of the partition member illustrated in FIG. 4.
Figure 7B:
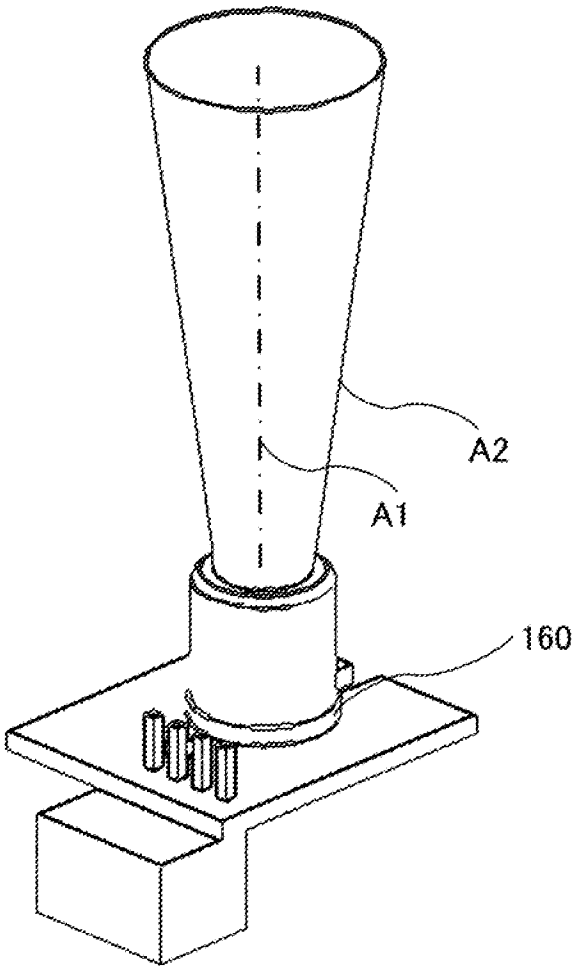
FIG. 7A is a diagram illustrating a perspective view of the temperature detector and FIG. 7B is a diagram illustrating a perspective view of a temperature detection range by the temperature detector.
Figure 7A:
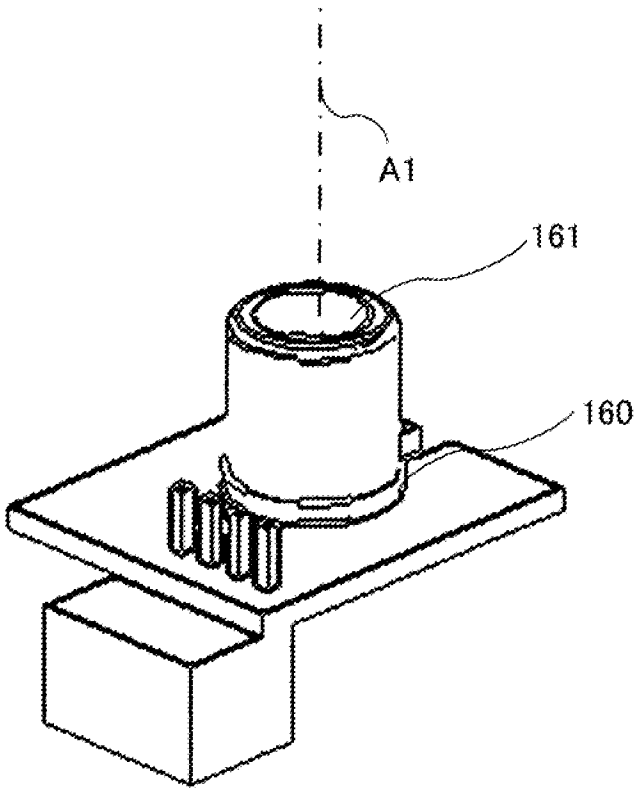

FIG. 4 is a diagram of a perspective view illustrating a structure including a temperature detector 160 and a partition member 170 of the image formation apparatus 10. FIG. 5 is a diagram illustrating a perspective view of the structure illustrated in FIG. 4 with the partition member 170 being omitted. FIG. 6 is a diagram illustrating a perspective view of the partition member 170 illustrated in FIG. 4. FIG. 7A is a diagram illustrating a perspective view of the temperature detector 160 illustrated in FIG. 3, and FIG. 7B is a diagram illustrating a perspective view of a temperature detection range A2 which is an area where the temperature detector 160 detects the temperature. The temperature detector 160 is, for example, a thermopile. The thermopile is a detection device including a lens 161, which is an optical system including a light incident surface (i.e., a window), and a sensor (not illustrated) that detects a temperature based on light (infrared light) passing through the lens 161. The light incident surface is the surface of the lens 161.

Figure 8:
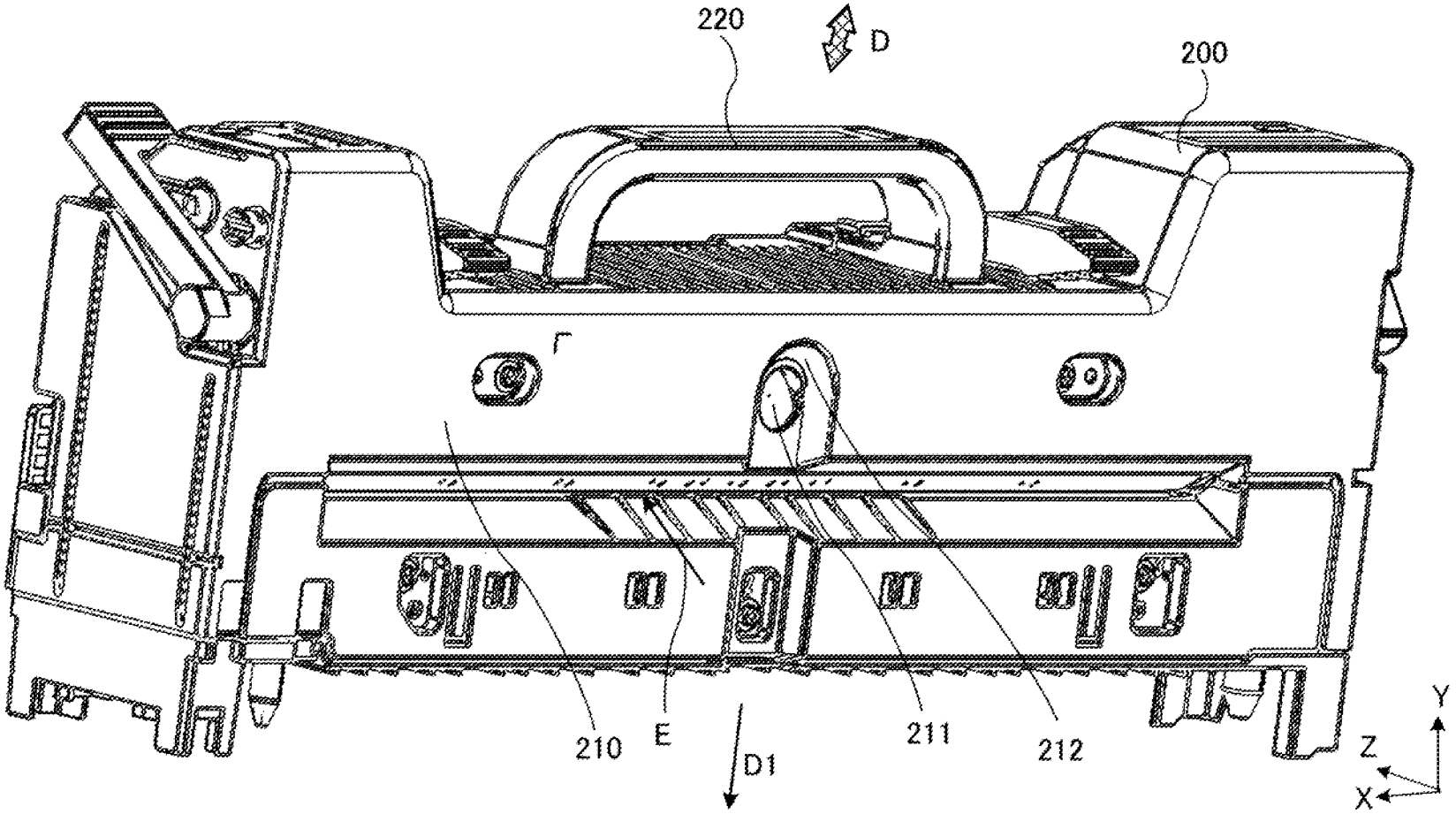
FIG. 8 is a diagram illustrating a perspective view of a side of the fixation device facing the temperature detector in the image formation apparatus according to a first embodiment.

FIG. 8 is a diagram illustrating a perspective view of the fixation device 200 of the image formation apparatus 10.

Figure 9:
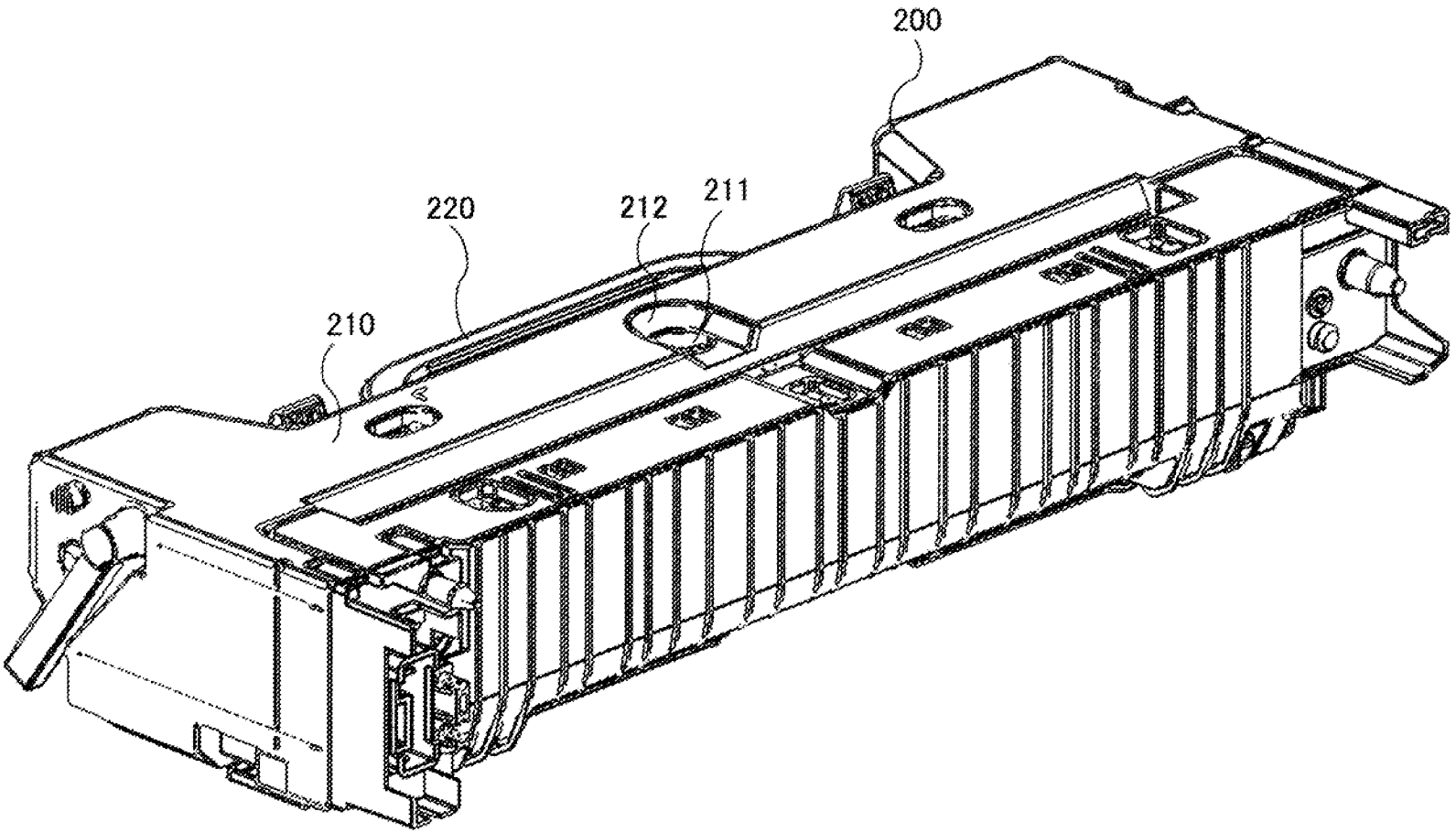
FIG. 9 is a diagram illustrating a perspective view of a bottom portion of the fixation device illustrated in FIG. 8.
Figure 10:
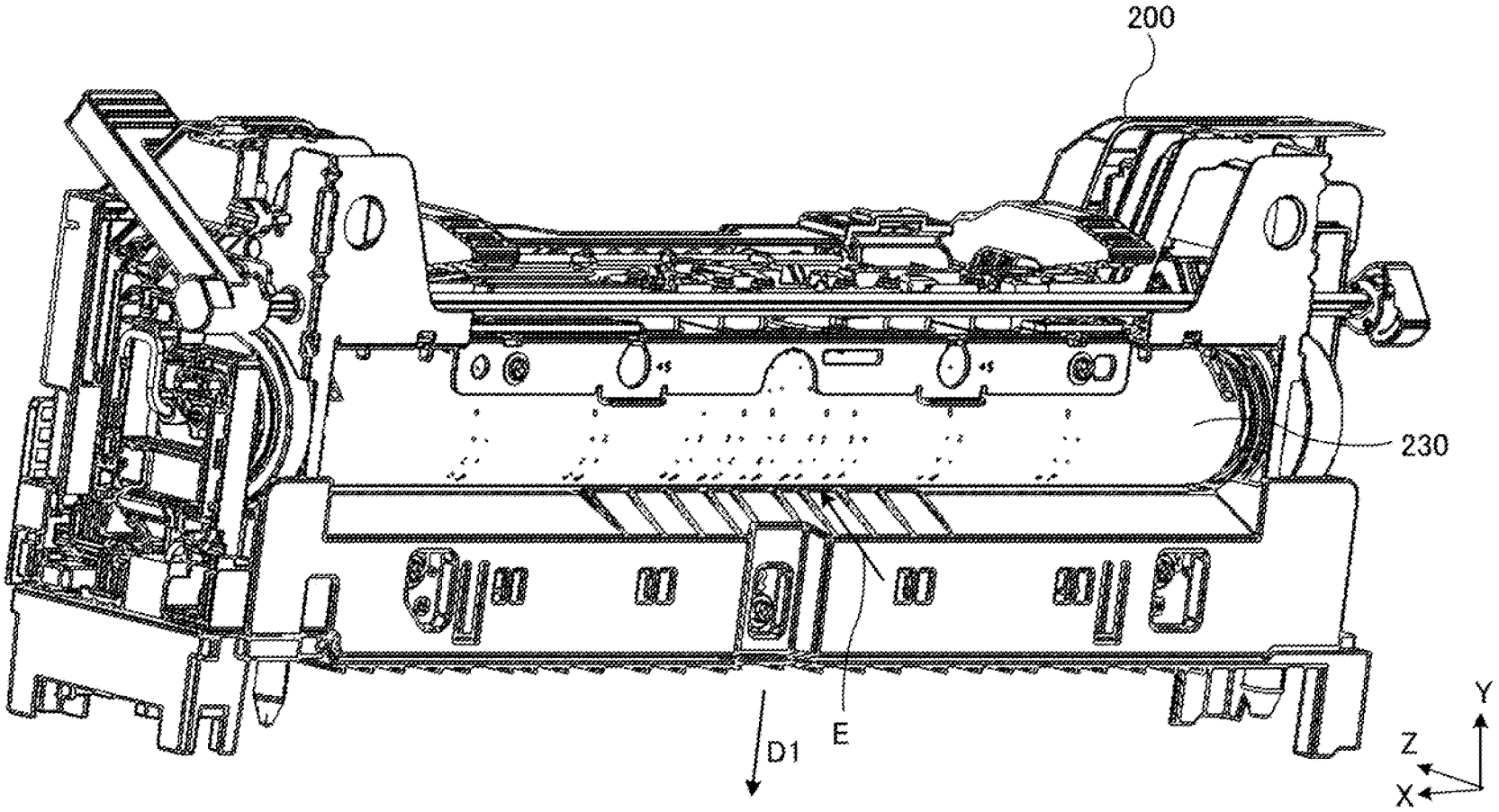
FIG. 10 is a diagram illustrating a perspective view of the structure illustrate in FIG. 8 with a cover member being omitted.
Figure 11:
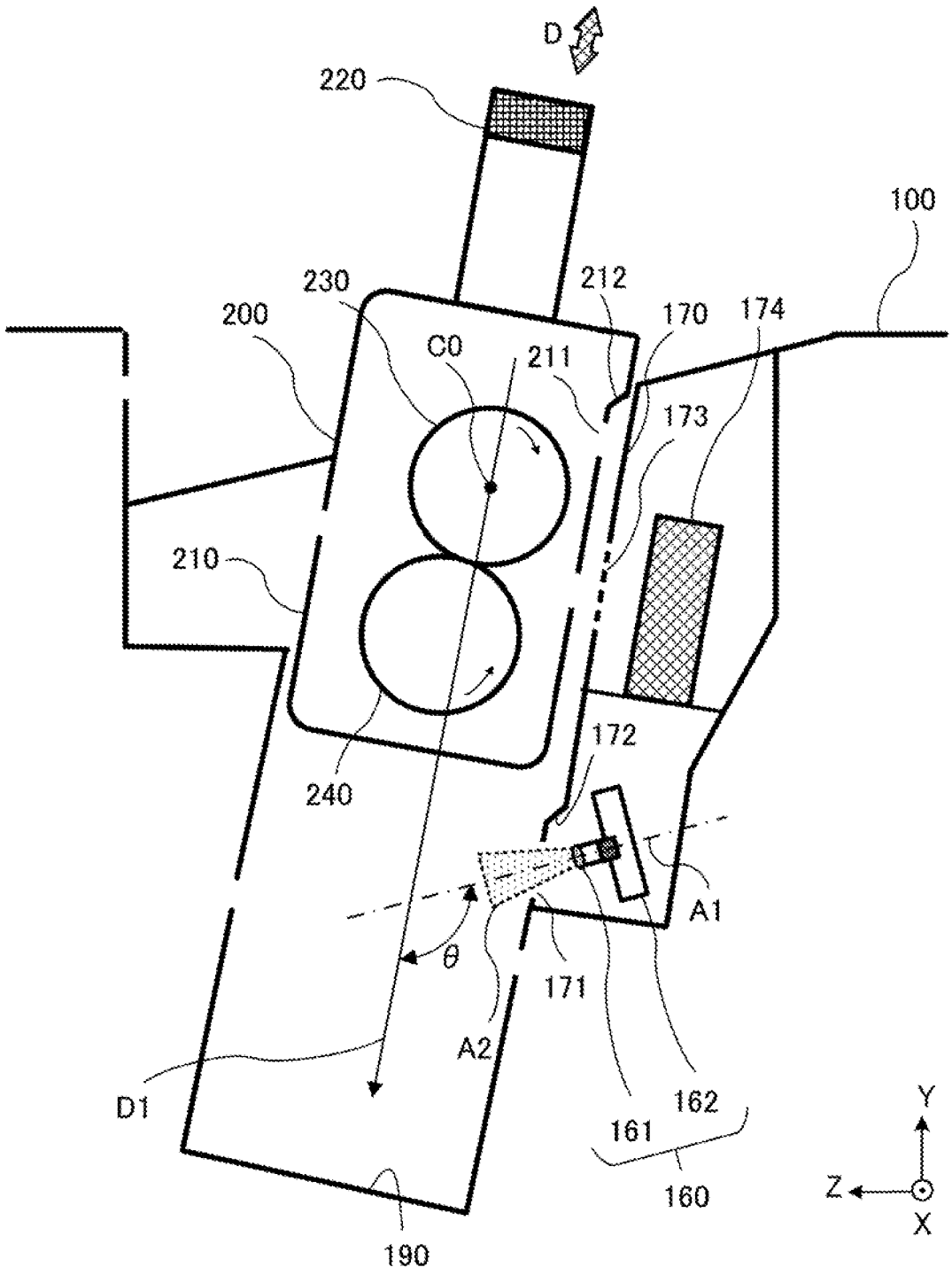
FIG. 11 is a diagram illustrating a schematic cross-sectional view for explaining insertion and removal of the fixation device into and from the main body of the image formation apparatus according to a first embodiment.
Figure 12:
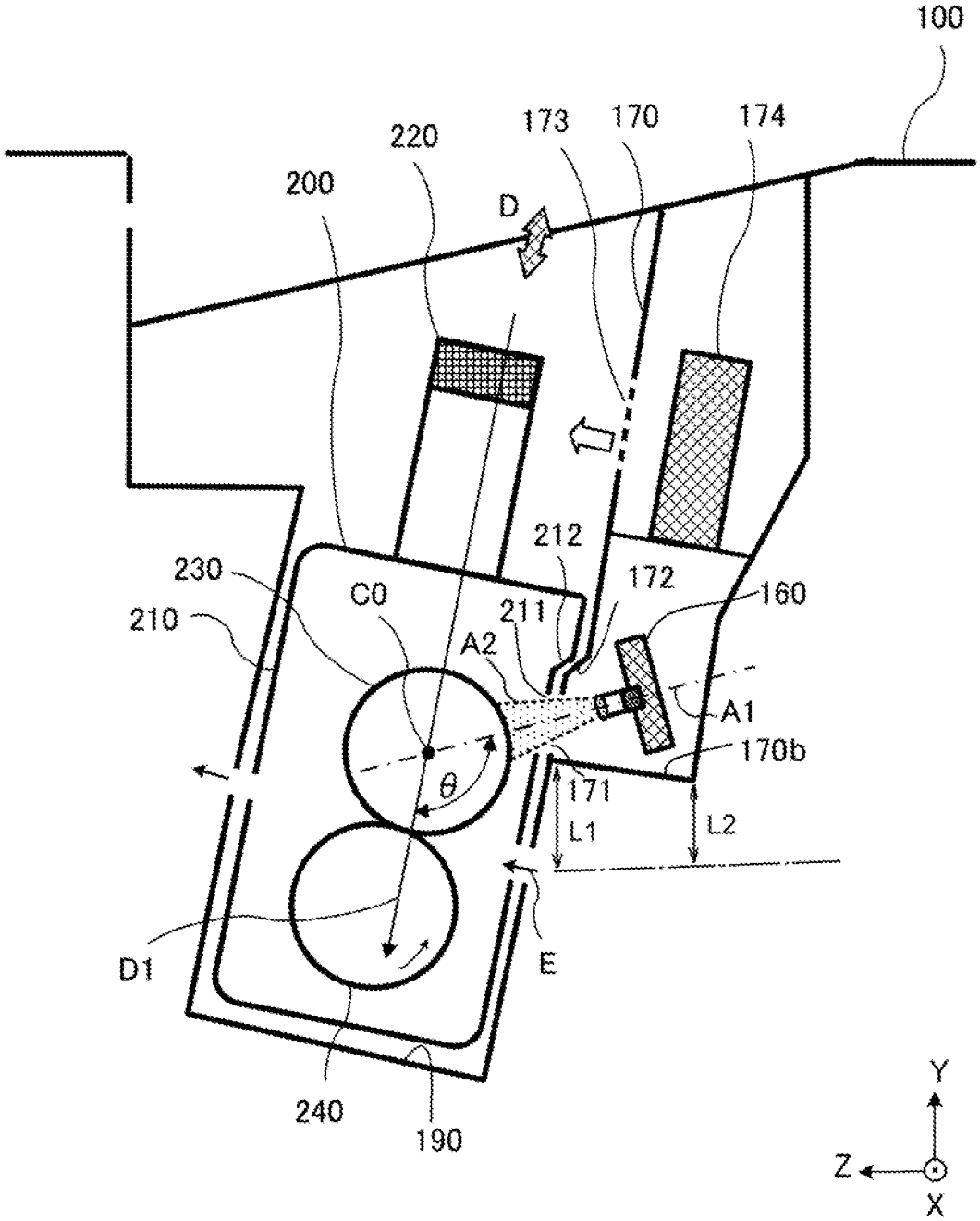
FIG. 12 is a diagram illustrating a schematic cross-sectional view of a state in which the fixation device is mounted to the main body of the image formation apparatus according to a first embodiment.
Figure 13:
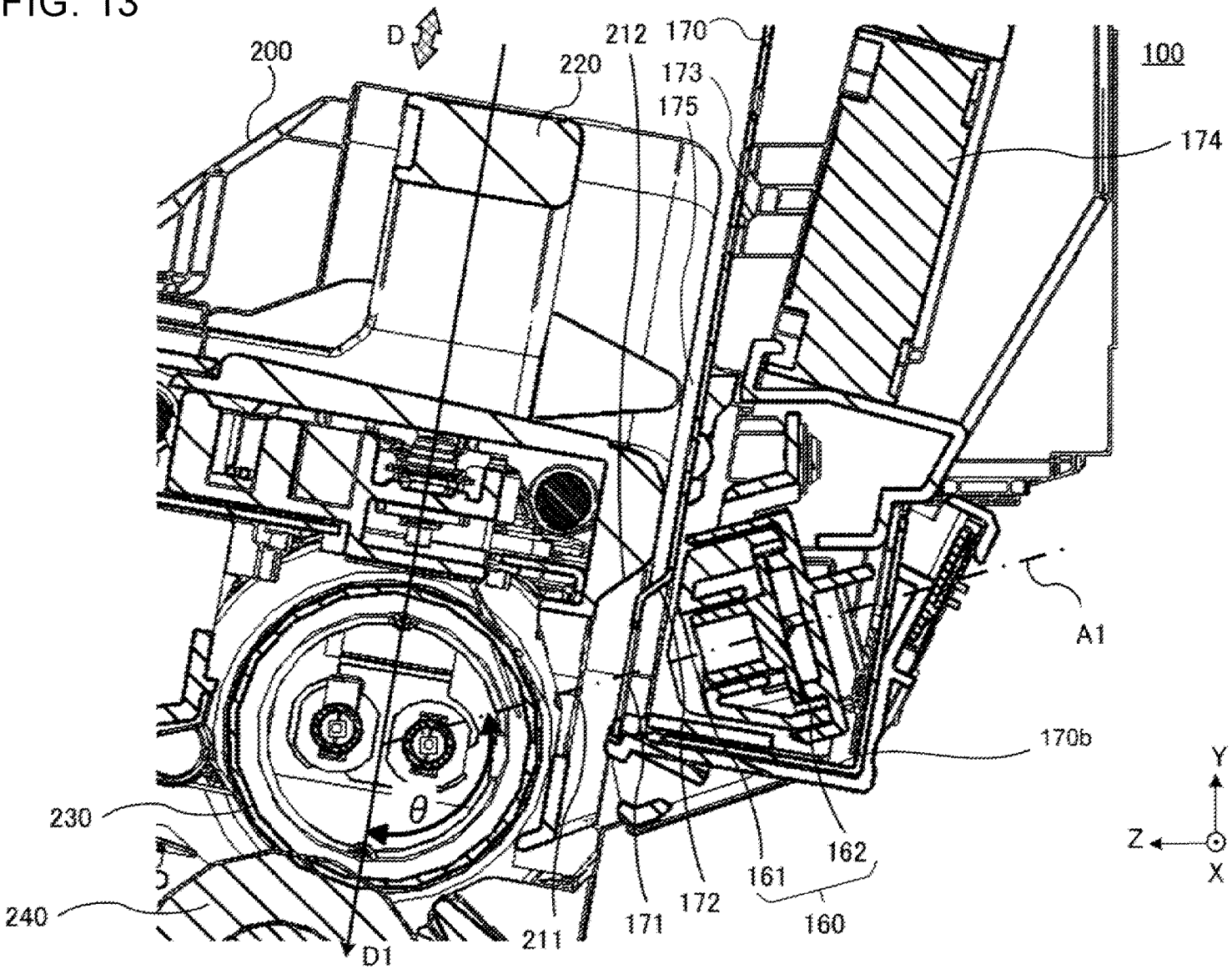
FIG. 13 is a diagram illustrating an enlarged cross-sectional for explaining an angle of an optical axis of a lens of the temperature detector with respect to a mounting direction of the fixation device in the image formation apparatus according to a first embodiment.

FIG. 9 is a diagram of a perspective view illustrating a bottom portion of the fixation device 200 illustrated in FIG. 8. FIG. 10 is a diagram illustrating a perspective view of the structure illustrated in FIG. 8 with the cover member 210 being omitted. FIG. 11 is a diagram of a schematic cross-sectional view for explaining the process of inserting and withdrawing the fixation device 200 in insertion and withdraw directions D (i.e., an insertion direction and a withdrawal direction) into and from the accommodation section 190 of the apparatus main body 100. FIG. 12 is a diagram of a schematic cross-sectional view illustrating a state in which the fixation device 200 is mounted to the apparatus main body 100 of the image formation apparatus 10. FIG. 13 is a diagram illustrating an enlarged cross-sectional for explaining an angle θ of an optical axis A1 of the lens 161 of the temperature detector 160 with respect to a mounting direction D1 (an attaching direction D1) of the fixation device 200 to the image formation apparatus 10. The mounting direction D1 is also referred to as the insertion direction.

The detection range A2 of the temperature detector 16 is illustrated in FIGS. 4, 5, and 7B. As illustrated in FIGS. 11 to 13, the apparatus main body 100 includes a mounting portion in which the temperature detector 160 is to be mounted.

A blower fan 174 (an air blowing fan) is provided above (on the +Y side of) the temperature detector 160. The partition member 170 is provided between the temperature detector 160 and the fixation device accommodation section 190 to partition between the temperature detector 160 and the fixation device 200. The partition member 170 is provided with airflow holes 173 through which air blown from the blower fan 174 passes. The air that has been passed through the airflow holes 173 passes through the accommodation section 190 that accommodates therein the fixation device 200, so as to cool the surroundings of the fixation device 200.

As illustrated in FIGS. 4, 6, and 11 to 13, a first through hole 171, which is like a peephole for the temperature detector 160, is formed in the partition member 170. In other words, the partition member 170 includes the first through hole 171 facing the lens 161 of the temperature detector 160. The partition member 170 is provided with convex portions 172 formed by processing a sheet metal for the partition member 170 and protruding toward the fixation device 200 at upper, right, and left sides of first through hole 171 (i.e., an upper portion of a periphery (an outer circumference) of the first through hole 171). The shape of the convex portion 172 is not limited to the one illustrated in the figures. Although it is possible not to include the convex portion 172, it may be preferable to include the convex portion 172 in light of preventing the lens 161 from being easily soiled.

As illustrated in FIGS. 8, 9, and 11 to 13, a second through hole 211, which is like a peep hole, is formed in the cover member 210 that surrounds the fixation roller 230. The cover member 210 includes the second through hole 211 facing and being aligned with the first through hole 171. The cover member 210 of the fixation device 200 is provided with a concave portion 212 (a recessed portion 212) around the second through hole 211. The second through hole 211 is formed in the concave portion 212 of the cover member 210 of the fixation device 200, that is, the second through hole 211 is formed at the bottom of the concave portion 212 of the cover member 210 of the fixation device 200. The temperature detector 160 detects the temperature of the fixation roller 230 through the first through hole 171 of the partition member 170 and the second through hole 211 of the cover member 210 of the fixation device 200. The shape of the concave portion 212 is not limited to the one illustrated in the figures.

The temperature detector 160 is provided on the upstream side (i.e., approximately in the −Z direction) in a medium conveyance direction (approximately in the Z direction in the fixation device 200) of the fixation device accommodation section 190. The fixation device 200 is detachably mounted in the accommodation section 190 of the apparatus main body 100.

The air blown from the blower fan 174 through the airflow holes 173 is directed to a downstream side in the medium conveyance direction (approximately in the +Z direction). A gap 175 (or a clearance 175) is provided between the fixation device 200 and the partition member 170. The fixation device 200 and the partition member 170, which form the gap 175 therebetween, include the concave portion 212 and a convex portion 172, respectively. The concave portion 212 and the convex portion 172 form a detour structure, a maze structure, or the like between the fixation device 200 and the partition member 170 and thus make it difficult for the air blown by the blower fan 174 to reach the lens 161 of the temperature detector 160, so as to prevent the lens 161 from being soiled An upper edge (an edge in the +Z direction) of the first through hole 171 is located on a downstream side in the mounting direction D1 than an upper end (an end in the +Z direction) of the surface of the lens 161 of the temperature detector 160. A bottom wall 170*b* of the partition member 170 is provided between the temperature detector 160 and the medium conveyance path along which the medium 180 is conveyed and thus separates the temperature detector 160 from the medium conveyance path. The bottom wall 170*b* of the partition member 170 is arranged in a manner that the bottom wall 170*b* of the partition member 170 approaches the optical axis A1 of the temperature detector 160 as it goes the downstream side (the +Z direction in FIG. 13) in the medium conveyance direction.

The fixation device 200 includes a fixation roller 230, which is a fixation member (heating member) configured to heat the medium 180, and a pressure roller 240 configured to be pressed against the fixation roller 230. The fixation roller 230 may be replaced with a rotating fixation belt. In the state where the fixation device 200 is mounted in the accommodation section 190 of the apparatus main body 100, the optical axis A1 of the lens 161 is inclined at a predetermined angle θ relative to the mounting direction D1. It is preferable that the temperature detector 160 be provided in the apparatus main body 100 with the optical axis A1 intersecting the fixation roller 230 in terms of improving the sensitivity of detection of the temperature. It is even more preferable that the optical axis A1 intersects a rotation axis C0 (a center axis C0) of the fixation roller 230, in terms of improving the sensitivity of detection of the temperature.

It is also preferable, in order to detect the temperature of the fixation roller 230 at a position close to the nip position 250, that the optical axis A1 intersects the surface of the fixation roller 230 at an upstream side, in the rotation direction of the fixation roller 230, from a nip position 250, which is a contact position between the fixation roller 230 and the medium 180.

The temperature detector 160 is provided in the apparatus main body 100 in a manner that the optical axis A1 points diagonally downward with respect to the horizontal direction (Z direction). With this configuration, dust, toner, or the like floating around the fixation device 200 is less likely to be adhered to the surface of the lens 161.

However, in a modification, the temperature detector 160 may be provided in the apparatus main body 100 in a manner that the optical axis A1 extends diagonally upward with respect to the horizontal direction (Z direction). In such a case, the dust, toner, or the like tends to be adhered to the surface of the lens 161 to some extent, but the temperature at a position close to the nip position 250 of the fixation roller 230 can be detected.

In the state where the fixation device 200 is mounted to the apparatus main body 100, the optical axis A1 of the lens 161 is inclined at a predetermined angle θ relative to the mounting direction D1, wherein the angle θ is, for example, within a range of 1° or more and 179° or less (i.e., 1°≤θ≤179°).

If the angle θ is out of the range of 1° or more and 179° or less, the surface of the optical lens substantially orthogonal to the optical axis A1 is located directly in front of the fixation device 200 in the mounting direction D1 upon mounting (inserting) the fixation device 200 to the apparatus main body 100. Therefore, the air flowing in the mounting direction D1, which is generated when the fixation device 200 is pushed in the mounting direction D1, hits the surface of the lens 161 more, to increase the amount of the dust, the toner, or the like adhered to the surface of the lens 161.

To the contrary, in the image formation apparatus 10 according to a first embodiment, the optical axis A1 of the lens 161 is inclined at the angle θ with respect to the mounting direction D1. Accordingly, the air flowing in the mounting direction D1, which is expected to occur most when the fixation device 200 is pushed in the mounting direction D1, is less likely to hit the surface of the lens 161, so as to reduce the amount of the air that hits the surface of the lens 161 when the air flows in the mounting direction D1. With this configuration, the amount of the dust, the toner, or the like adhered to the surface of the lens 161 is reduced.

In the image formation apparatus 10 according to a first embodiment, it may be preferable that the angle θ is within a range of 30° or more and 150° or less (i.e., 30°≤θ≤150°). In this case, since the optical axis A1 of the lens 161 is inclined at the angle of 30° or more with respect to the mounting direction D1, the amount of the air that hits the surface of the lens 161 is reduced, when the air flows in the mounting direction D1, which is generated by the wind pressure upon inserting the fixation device 200 in the mounting direction D1. Therefore, the amount of the dust, toner, or the like adhered to the surface of the lens 161 is reduced.

In the image formation apparatus 10 according to a first embodiment, it may be more preferable that the angle θ is within a range of 90° or more and 150° or less (i.e., 90°≤θ≤150°). In this case, since the optical axis A1 of the lens 161 is inclined at the angle of 90° or more with respect to the mounting direction D1, the amount of the air that hits the surface of the lens 161 is further reduced, when the air flows in the mounting direction D1, which is generated by the wind pressure upon inserting the fixation device 200 in the mounting direction D1. Therefore, the amount of the dust, the toner, or the like adhered to the surface of the lens 161 is further reduced.

The partition member 170 is formed with the plurality of airflow holes 173 through which the air sent from the blower fan 174 passes, and the convex portion 172 provided at the periphery of the first through hole 171 and thus provided between the first through hole 171 and the plurality of airflow holes 173. The cover member 210 includes the concave portion 212 opposed to the convex portion 172 and formed with the second through hole 211.

When the fixation device 200 is mounted in the fixation device accommodation section 190 of the apparatus main body 100, the dust, toner or the like inside or outside the accommodation section 190 is flown up. Although the dust, toner, or the like falls down in the direction of gravity after being flown up, the dust, toner, or the like is less likely to be adhered to the surface of the lens 161 because the surface of the lens 161 of the temperature detector 160 faces the downstream side of the mounting direction D1 of the fixation device 200.

When the blower fan 174 is activated to start blowing the air during the printing operation of the image formation apparatus 10, the dust, toner, or the like inside or outside the apparatus main body 100 is blown up and is blown into the fixation device accommodation section 190 together with the blown air. Because of the gap 175 between the fixation device 200 and the partition member 170, the air sent by the blower fan 174 flows through the gap 175 toward the inside of the accommodation section 190 of the fixation device 200. However, since the convex portion 172 is provided around the first through hole 171 of the partition member 170, and the concave portion 212 of the cover member 210 overlaps the convex portion 172 of the partition member 170 with the gap therebetween, it is difficult for the dust, the toner, or the like raised by the wind from the blower fan 174 to pass the first through hole 171 via the gap 175. Therefore, it is less likely for the dust, the toner, or the like blown with the air to be adhered to the surface of the lens 161.

The toner image formed in the image formation section is transferred to the medium 180, is conveyed to the fixation device 200 in the E direction, and fixed to the medium 180 in the fixation device 200. Since the toner on the medium 180 being conveyed under the temperature detector 160 is unfixed before the toner is fixed to the medium 180 by the fixation device 200, the unfixed toner may soar up from the medium 180 to a certain height and fall down. In a first embodiment, the bottom wall **170*b* of the partition member 170, which is provided below the temperature detector 160, is inclined with respect to the medium conveyance path (see FIG. 12) in such a manner that a downstream end portion, in the medium conveyance direction, of the bottom wall 170*b* is provided farther from the media conveyance path, than an upstream end portion, in the medium conveyance direction, of the bottom wall 170*b*. That is, as illustrated in FIG. 12, a distance L1 from the downstream end portion of the bottom wall 170*b* to the medium conveyance path in the vertical direction is greater than a distance L2 from the upstream end portion of the bottom wall 170*b* to the medium conveyance path in the vertical direction. Accordingly, the unfixed toner on the medium being conveyed in the medium conveyance path is less likely to be attached to the downstream side of the bottom wall 170*b* (which is provided on a side closer to the through hole 171) than the upstream side of the bottom wall 170*b* (which is provided on a side farther from the through hole 171). Therefore, this configuration suppresses the unfixed toner on the medium being conveyed along the medium conveyance path from being adhered to the temperature detector 160, which is provided above the bottom wall 170*b* of the partition member 170**.

(1-3) Effects

As described above, in a first embodiment, although the dust, the toner, or the like is scattered when the fixation device 200 is inserted or removed, the dust, toner, or the like is less likely to be adhered to the lens 161 of the temperature detector 160. Therefore, temperature detection failure and printing failure are less likely to occur.

The concave portion 212 of the cover member 210 of the fixation device 200 and the convex portion 172 of the partition member 170 overlap each other with the gap therebetween. This configuration suppresses the dust, the toner, or the like that is blown by the blower fan 174 during the operation of the image formation apparatus from being adhered to the surface of the lens 161 of the temperature detector 160. Therefore, the temperature detection failure is less likely to occur even during the operation of the image formation apparatus. Further, even when the unfixed toner flies from the medium, this configuration suppresses the unfixed toner from being adhered to the detection part of the temperature detector 160, so as to suppress the temperature detection failure.

(2) Second Embodiment

In a first embodiment, the case has been described in which the fixation device 200 is inserted in the mounting direction D1 from the upper opening of the accommodation section 190 of the apparatus main body 100. In a second embodiment, an example is described in a fixation device 200*a* is inserted in a mounting direction D1 from a side opening of an accommodating portion 190*a* of an apparatus main body 100*a*.

Figure 14:
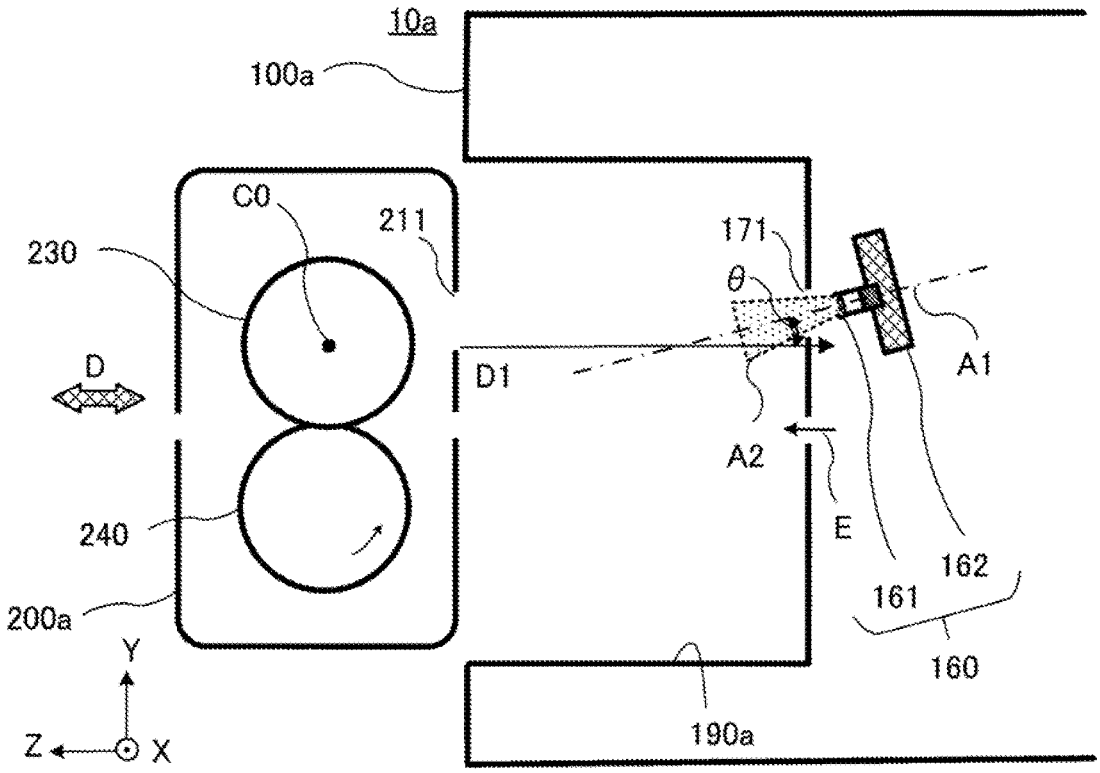
FIG. 14 is a diagram illustrating a schematic cross-sectional view for explaining insertion and removal of a fixation device into and from a main body of an image formation apparatus according to a second embodiment.
Figure 15:
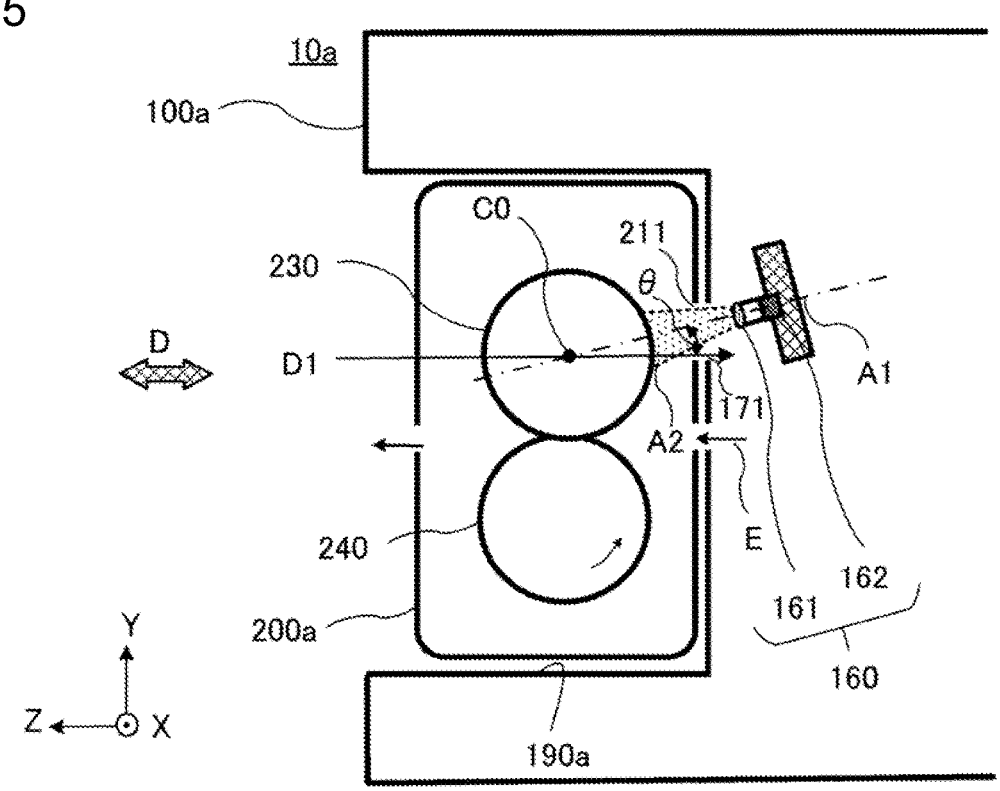
FIG. 15 is a diagram illustrating an enlarged cross-sectional for explaining an angle of an optical axis of a lens of a temperature detector with respect to a mounting direction of the fixation device in the image formation apparatus according to a second embodiment.

FIG. 14 is a diagram of a schematic cross-sectional view for explaining the process of inserting and removing the fixation device 200*a* into and from the accommodation section 190*a* of the apparatus main body 100*a* of the image formation apparatus 10*a* according to a second embodiment. FIG. 15 is a diagram of a schematic cross-sectional view for explaining an angle θ of the optical axis A1 of the lens 161 of the temperature detector 160 with respect to the mounting direction D1 of the fixation device 200*a* to be mounted in the accommodation section 190*a* of the apparatus main body 100*a* of the image formation apparatus 10*a*.

As illustrated in FIGS. 14 and 15, in a second embodiment, the optical axis A1 of the lens 161 is also inclined at the angle θ, relative to the mounting direction D1, which is the first direction. In the state where the fixation device 200*a* is mounted in the accommodation section 190*a* of the apparatus main body 100*a*, the optical axis A1 of the lens 161 is inclined at the predetermined angle θ relative to the mounting direction D1, wherein the angle θ is, for example, within a range of 1° or more and 179° or less (i.e., 1°≤θ≤179°).

In the image formation apparatus 10*a* according to a second embodiment, since the optical axis A1 of the lens 161 is inclined at the angle θ with respect to the mounting direction D1, the amount of the air that hits the surface of the lens 161 becomes small, when the air flows in the mounting direction D1, which is considered to be generated most by the wind pressure upon pushing the fixation device 200*s* in the mounting direction D1. As a result, this configuration suppresses the dust, the toner, or the like floating in the air from being adhered to the surface of the lens 161.

In the image formation apparatus 10*a* according to a second embodiment, it may be preferable that the angle θ is within a range of 30° or more and 150° or less (i.e., 30°≤θ≤150°). In this case, since the optical axis A1 of the lens 161 is inclined at the angle of 30° or more with respect to the mounting direction D1, the amount of the air that hits the surface of the lens 161 is reduced, when the air flows in the mounting direction D1, which is generated upon pushing the fixation device 200*a* in the mounting direction D1. As a result, this configuration further suppresses the dust, the toner, or the like floating in the air from being adhered to the surface of the lens 161.

In the image formation apparatus 10*a* according to a second embodiment, it may be further preferable that the angle θ is within a range of 30° or more and 90° or less (i.e., 30°≤θ≤90°). In this case, since the optical axis A1 of the lens 161 is inclined at the angle of 30° or more with respect to the mounting direction D1, the amount of the air that hits the surface of the lens 161 is further reduced, when the air flows in the mounting direction D1, which is generated upon pushing the fixation device 200*a* in the mounting direction D1. As a result, the configuration further suppresses the dirt such as the dust, the toner, or the like from being adhered to the surface of the lens 161.

Except for the configurations described above, a second embodiment is the same as a first embodiment.

(3) Third Embodiment

In a first embodiment, the case has been described in which the fixation device 200 is inserted in the mounting direction D1 from the upper opening of the accommodation section 190 of the apparatus main body 100. In a third embodiment, an example is described in which a fixation device 200*b* is inserted in the mounting direction D1 from a side opening of an accommodation section 190*b* of an apparatus main body 100*b*, and the temperature detector 160 detects the temperature of the fixation roller 230 through a first through hole 171*b* and a second through hole 211*b* from above the fixation device 200*b*.

Figure 16:
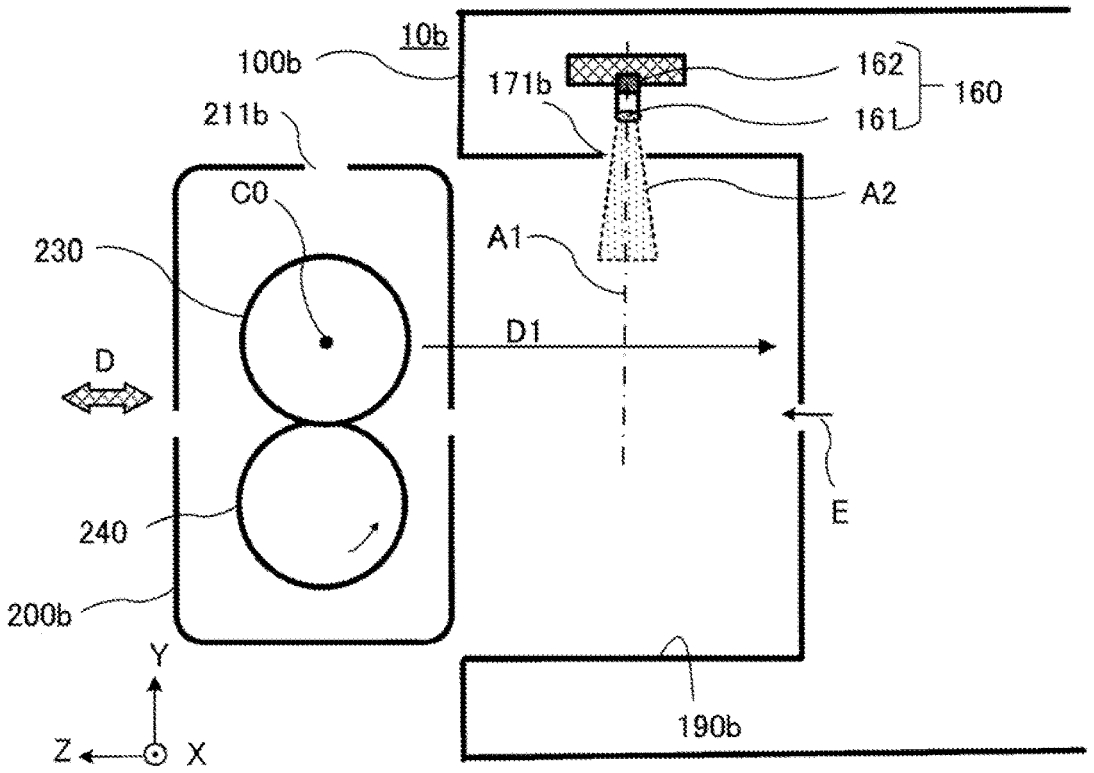
FIG. 16 is a diagram illustrating a schematic cross-sectional view for explaining insertion and removal of a fixation device into and from a main body of an image formation apparatus according to a third embodiment.
Figure 17:
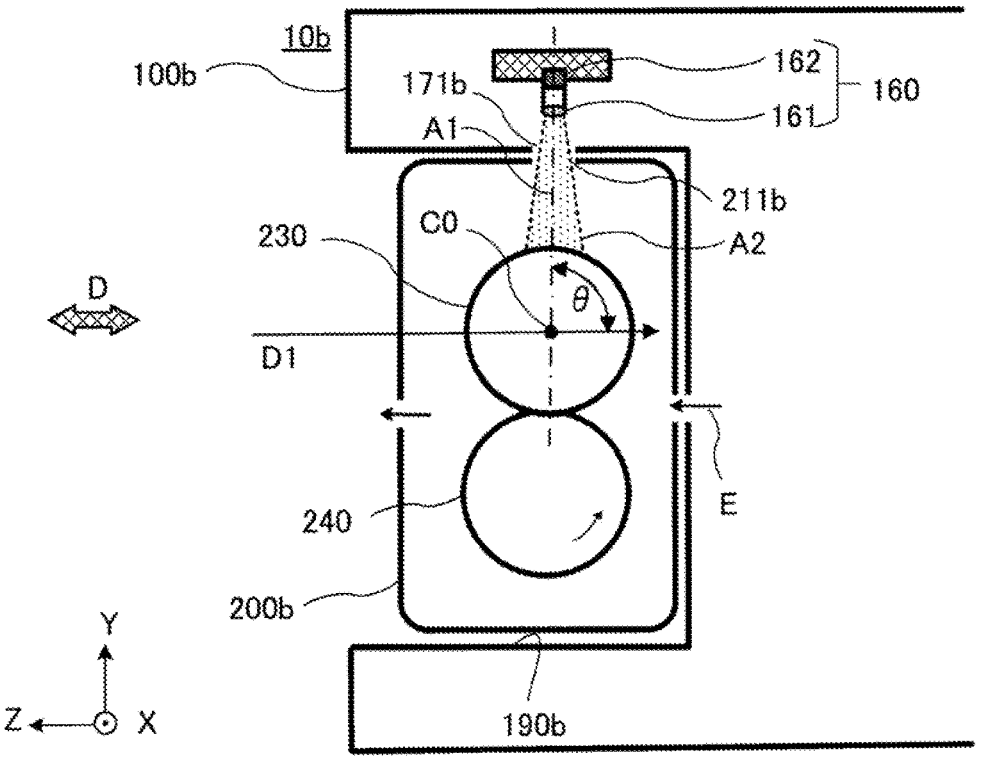
FIG. 17 is a diagram illustrating an enlarged cross-sectional view for explaining an angle of an optical axis of a lens of a temperature detector with respect to a mounting direction of the fixation device in the image formation apparatus according to a third embodiment.

FIG. 16 is a diagram of a schematic cross-sectional view illustrating the process of inserting and removing the fixation device 200*b* to and from the accommodation section 190*b* of the apparatus main body 100*b* of an image formation apparatus 10*b* according to a third embodiment. FIG. 17 is a diagram of a schematic cross-sectional view for explaining an angle θ of the optical axis A1 of the lens 161 of the temperature detector 160 with respect to the mounting direction D1 of the fixation device 200*b* to be mounted in the accommodation section 190*b* of the main body 100*b* of the image formation apparatus 10*b*.

As illustrated in FIGS. 16 and 17, in a third embodiment, the optical axis A1 of the lens 161 is also inclined at the angle θ relative to the mounting direction D1 serving as the first direction. In the state where the fixation device 200*b* is mounted in the accommodation section 190*b* of the main body 100*b*, the optical axis A1 of the lens 161 is inclined at the predetermined angle θ relative to the mounting direction D1, wherein the angle θ is, for example, within a range of 1° or more and 179° or less (i.e., 1°≤θ≤179°).

In the image formation apparatus 10*b* according to a third embodiment, since the optical axis A1 of the lens 161 is inclined at the angle θ with respect to the mounting direction D1, the amount of the air that hits the surface of the lens 161 becomes small, when the air flows in the mounting direction D1, which is considered to be generated most by the wind pressure upon pushing the fixation device 200*b* in the mounting direction D1. As a result, this configuration suppresses the dust, the toner, or the like floating in the air from being adhered to the surface of the lens 161.

In the image formation apparatus 10*b* according to a third embodiment, it may be preferable that the angle θ is within a range of 30° or more and 150° or less (i.e., 30°≤θ≤150°). In this case, since the optical axis A1 of the lens 161 is inclined at the angle of 30° or more with respect to the mounting direction D1, the amount of the air that hits the surface of the lens 161 is reduced, when the air flows in the mounting direction D1, which is generated upon pushing the fixation device 200*b* in the mounting direction D1. As a result, this configuration suppresses the dust, the toner, or the like floating in the air from being adhered to the surface of the lens 161.

In the image formation apparatus 10*b* according to a third embodiment, it may be more preferable that the angle θ is within a range of 90° or more and 150° or less (i.e., 90°≤θ≤150°). In this case, since the optical axis A1 of the lens 161 is inclined at the angle of 90° or more with respect to the mounting direction D1, the amount of the air that hits the surface of the lens 161 is further reduced, when the air flows in the mounting direction D1, which is generated upon pushing the fixation device 200*b* in the mounting direction D1. As a result, the configuration further suppresses the dirt such as the dust, toner, or the like from being adhered to the surface of the lens 161.

Except for the configurations described above, a third embodiment is the same as a first embodiment.

(4) Modification

In one or more embodiments described above, the case has been described in which the image formation apparatus includes only one process unit which configured to form a toner image and transfer the toner image to the medium 180 being conveyed. However, the disclosure is not limited thereto. The disclosure is applicable to an image formation apparatus that transfers a toner image to a medium 180 via an intermediate transfer belt, and an image formation apparatus that forms a color image using a plurality of process units.

Further, in one or more embodiments described above, the case has been described in which the image formation apparatus is a printer. However, the disclosure is applicable to an image formation apparatus which is a copier, a facsimile machine, a multifunction machine, or the like. Further, the disclosure is also applicable to other devices, wherein a device main body is equipped with a temperature detector and a unit is inserted into an accommodation section in the device main body.

The invention includes other embodiments or modifications in addition to one or more embodiments and modifications described above without departing from the spirit of the invention. The one or more embodiments and modifications described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

an apparatus main body that includes an image formation section configured to form an image on a medium;

a fixation device that includes a fixation member configured to heat the medium and is configured to be attached to the apparatus main body in an attaching direction;

a temperature detector including a lens, provided in the apparatus main body, and configured to detect a temperature of the fixation member through the lens; and a partition member provided in the apparatus main body and dividing a space between the temperature detector and the fixation device, the partition member including a first through hole through which the lens faces the fixation member, wherein an optical axis of the lens is inclined with respect to the attaching direction of the fixation device, and an angle of a line segment extending from a rotation axis of the fixation member in the attaching direction of the fixation device with respect to a line segment extending from the rotation axis of the fixation member toward the lens is within a range of 90 degrees or more and 150 degrees or less.

2. The image formation apparatus according to claim 1, wherein the temperature detector is provided in the apparatus main body in a manner that the optical axis intersects the fixation member.

3. The image formation apparatus according to claim 2, wherein the fixation member is a rotating roller or a rotating belt, and the optical axis intersects the fixation member at a position upstream, in a rotation direction of the fixation member, from a contact position between the fixation member and the medium.

4. The image formation apparatus according to claim 2, wherein the optical axis intersects the rotation axis of the fixation member.

5. The image formation apparatus according to claim 1, wherein the temperature detector is provided in the apparatus main body in a manner that a direction from the lens to the fixation member is oriented diagonally downward and the optical axis is inclined with respect to a horizontal direction.

6. The image formation apparatus according to claim 1, wherein the temperature detector is provided in the apparatus main body in a manner that the optical axis is oriented diagonally upward with respect to a horizontal direction.

7. The image formation apparatus according to claim 1, wherein the fixation device further includes a cover member covering the fixation member, the partition member includes the first through hole facing the lens, and the cover member includes a second through hole facing the first through hole in a manner that the temperature detector is provided to detect the temperature of the fixation member through the first through hole and the second through hole.

8. The image formation apparatus according to claim 7, wherein the partition member further includes an airflow hole through which air sent from a blower fan to the fixation device passes and a convex portion formed around the first through hole and provided at a position between the airflow hole and the first through hole, and the cover member further includes a concave portion in which the second through hole is provided and that faces the convex portion.

9. The image formation apparatus according to claim 1, wherein the apparatus main body includes an accommodation section including an upper opening, and the fixation device is inserted from the upper opening into the accommodation section in the attaching direction of the fixation device.

10. The image formation apparatus according to claim 1, wherein the apparatus main body has an accommodation section including an opening on a side of the accommodation section, and the fixation device is inserted from the opening into the accommodation section in the attaching direction of the fixation device.

11. An image formation apparatus comprising:

an apparatus main body that includes an image formation section configured to form an image on a medium;

a fixation device that includes a fixation member configured to heat the medium and is configured to be attached to the apparatus main body in an attaching direction; and a temperature detector including a lens, provided in the apparatus main body, and configured to detect a temperature of the fixation member through the lens, wherein an optical axis of the lens is inclined with respect to the attaching direction of the fixation device, and an angle of a line segment extending from a rotation axis of the fixation member in the attaching direction of the fixation device with respect to a line segment extending from the rotation axis of the fixation member toward the lens is within a range of 90 degrees or more and 150 degrees or less.

* * * * *